US006637791B1

(12) United States Patent
Steadman

(10) Patent No.: US 6,637,791 B1
(45) Date of Patent: Oct. 28, 2003

(54) COLLECTION APPARATUS

(75) Inventor: William D. Steadman, 2166 SE. Pyramid Rd., Port Saint Lucie, FL (US) 34952

(73) Assignee: William D. Steadman, Port Saint Lucie, FL (US)

( * ) Notice: Subject to any disclaimer, the term of this patent is extended or adjusted under 35 U.S.C. 154(b) by 0 days.

(21) Appl. No.: 09/937,115

(22) PCT Filed: Mar. 14, 2000

(86) PCT No.: PCT/GB00/00958

§ 371 (c)(1),
(2), (4) Date: Jan. 28, 2002

(87) PCT Pub. No.: WO00/55432

PCT Pub. Date: Sep. 21, 2000

(30) Foreign Application Priority Data

| | | |
|---|---|---|
| Feb. 2, 1999 | (DE) | 299 01 774 U |
| Apr. 17, 1999 | (DE) | 199 17 414 |
| Jul. 19, 1999 | (DE) | 199 33 364 |

(51) Int. Cl.[7] ..... A01K 29/00; A47L 13/52

(52) U.S. Cl. ..... 294/1.3; 294/55; 15/257.6; 15/257.7

(58) Field of Search ..... 294/1.3–1.5, 55; 15/104.8, 257.1, 257.2, 257.4, 257.6, 257.7; 119/161, 867

(56) References Cited

U.S. PATENT DOCUMENTS

| | | | | |
|---|---|---|---|---|
| 3,778,097 A | | 12/1973 | Dorzan | |
| 3,827,098 A | * | 8/1974 | Sanderson | 294/1.4 |
| 3,910,619 A | * | 10/1975 | Schmieler | 294/1.4 |
| 3,977,715 A | | 8/1976 | Casci | |
| 4,225,174 A | * | 9/1980 | Hennessy et al. | 294/1.4 |
| 4,641,873 A | * | 2/1987 | Nurnberger | 294/1.4 |
| 5,033,781 A | | 7/1991 | Flood | |
| 5,702,138 A | | 12/1997 | Elkind | |

FOREIGN PATENT DOCUMENTS

| | | | | |
|---|---|---|---|---|
| NL | 8302125 | * | 1/1985 | 294/1.3 |
| WO | 92/21857 | * | 12/1992 | 294/1.3 |

OTHER PUBLICATIONS

International Search Report, pp. 1–2, Dated Jun. 6, 2000.

* cited by examiner

*Primary Examiner*—Christopher P. Ellis
*Assistant Examiner*—Paul T. Chin
(74) *Attorney, Agent, or Firm*—Watts, Hoffmann, Fisher & Heinke Co., L.P.A.

(57) ABSTRACT

A collection apparatus (10) suitable for collecting dog excreta and the like. The apparatus (10) comprises an elongate main member (12) and an open square frame (32) pivotally mounted on the member (12) towards one end thereof. The apparatus (10) also comprises a container (36) with a hinged lid (50). The container (36) is selectively locatable in the frame (32), such that excreta can be picked up in the container (36) and the lid (50) automatically closed, by pivoting of the frame (32).

12 Claims, 12 Drawing Sheets

COLLECTION APPARATUS

This invention concerns collection apparatus, and particularly but not exclusively apparatus for collecting dog excreta.

BACKGROUND OF THE INVENTION

Dog excreta on pavements and elsewhere can be a significant problem and also a health risk. Dog owners are presently being encouraged to remove their dog excreta from public places, and in some instances this is required by law. A number of arrangements have been provided for use in clearing up dog excreta. In general though these have not proved wholly satisfactory, and are often not pleasant and/or hygienic to use.

BRIEF SUMMARY OF THE INVENTION

According to the present invention there is provided collection apparatus, the apparatus comprising a main member with a body which can be held by a user, and a frame member arranged to removably mount an open top container with a lid, the frame member being movably mounted on the body so as to be movable between a first position wherein material can be scooped up into the container from the ground, and a second position urging the lid to substantially close the container.

An operating handle may be provided on the body connected to the frame member to facilitate movement of the frame member relative to the body. The operating handle may be pivotally mounted on the body and/or pivotally connected to the frame member. The frame member may be pivotally mounted on the body.

A part of the body may comprise a grip handle. An abutment member may be provided on the body against which a container lid is engageable to close same.

The frame member may comprise an open frame through which a part of a container can extend, with a wider part of the container engaging against the frame.

The apparatus, may be arranged such that when moved fully to the second position the frame member will be automatically retained in the second position. An over centre locking arrangement may be provided to provide the automatic retention, which arrangement is desirably provided between the body and the frame member.

A hook may be provided on the apparatus to permit same to be hung up, and the hook may be provided on a free end of the grip handle.

The invention also provides collection apparatus, the apparatus comprising a main member according to any of the preceding six paragraphs, and a container removably mountable thereon to receive material from the ground.

The container preferably comprises a main body part which slidingly fits in the frame of the main member, and an upper part which engages thereagainst. The main body part preferably tapers inwardly away from the upper part.

The container preferably includes a pivotally mounted lid which is closable against said upper part. Locking means are preferably provided on the lid and/or remainder of the container. The locking means are preferably automatically engageable to lock closed the container lid when the latter is moved to a closed position.

The locking means may comprise engageable formations. Alternatively, the locking means may comprise adhesive means .which adhesive means may be, provided on the upper part and engageable with the lid, or vice versa Selectively removable backing means may be provided on the adhesive means.

Means may be provided for retaining the lid in an open state. The retaining means may comprise a member extending from the lid, which member can be held by a person holding the main member body. The retaining means may comprise a strip of flexible material.

A plurality of containers are preferably provided for each main member, and different sizes of containers may be provided.

A main lip may be provided on the upper part of the or each container on an opposite side thereof to the pivoting of the lid. The main lip preferably overlies the frame when mounted thereon, and may extend beyond the frame when mounted thereon.

The or part of the locking means may be provided on the main lip. A lip may be provided on the container lid which overlies the main lip when the container is closed, and the or part of the locking means may be provided on the lid lip. The lip on the container lid may be larger than the main lip, and said lid lip may include upstanding side edges which can enclose the main lip.

Side lips may be provided on the sides of the upper part of the or each container which at least substantially overlie the frame when mounted thereon.

The container may be made by moulding a material such as plastics material or papermache. The container may be formed to stack on similar such containers.

Alternatively, the container may be formed from a blank which can be manipulated into an erect state. The blank may be formed of card.

Means may be provided for maintaining the blank in an erect state. The maintaining means may be automatically operable upon the blank being manipulated to the erect state. The maintaining means may comprise adhesive means.

The blank may be arranged such that location thereof in the frame member maintains the blank in the erect state.

The blank may be arranged such that closing of the lid maintains the blank in the erect state.

The blank may comprise a base part with two pairs of opposite side parts extending from the base part, with hinge means provided between adjacent side parts. The blank may be arranged such that folding of a one of the pairs of side parts relative to the base part and moving said side parts towards each other, automatically causes the blank to move substantially to an erect state.

The main lip and lid preferably extend from opposite sides parts of a one pair. The side lips preferably extend from opposite side parts of the other pair.

The invention also provides a container according to any of the preceding sixteen paragraphs.

BRIEF DRAWING DESCRIPTION

Embodiments of the present invention will now be described by way of example only and with reference to the accompanying drawings, in which.

DETAILED DESCRIPTION OF THE INVENTION

Figure 1:
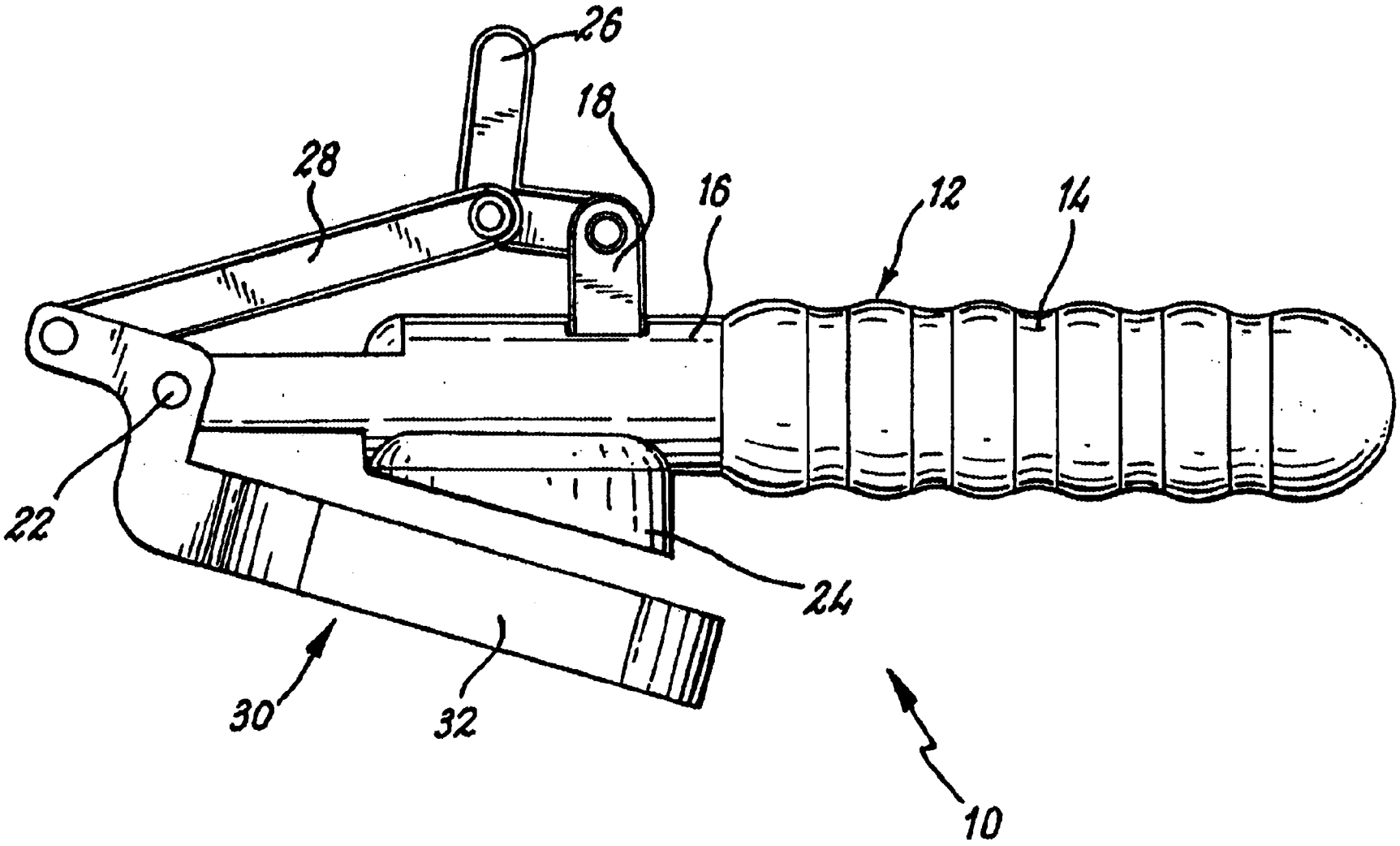
FIG. 1 is a diagrammatic side view of a first apparatus according to the invention in a closed position.
Figure 2:
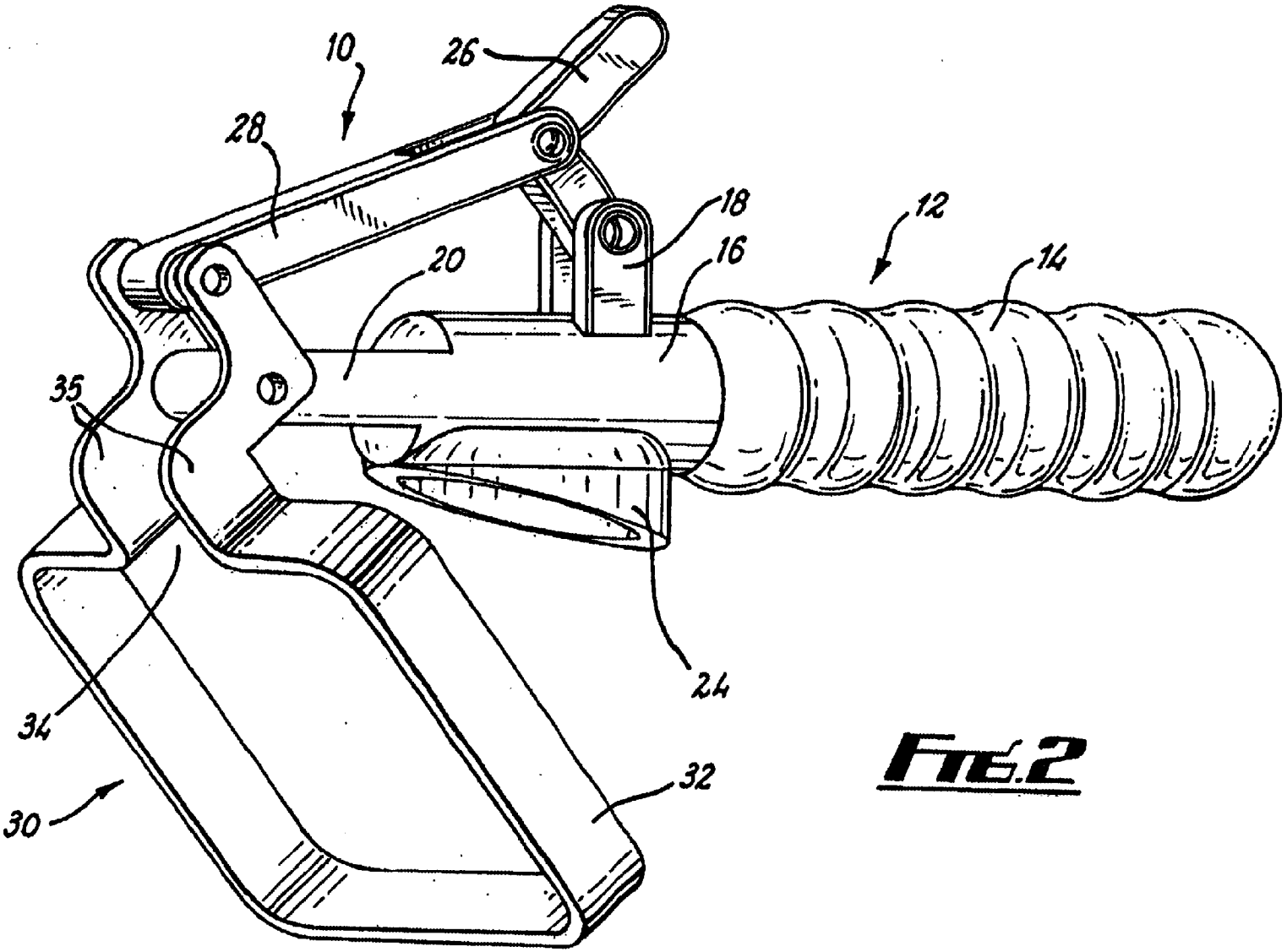
FIG. 2 is a diagrammatic perspective view of the apparatus of FIG. 1 in a partially closed position.
Figure 3:
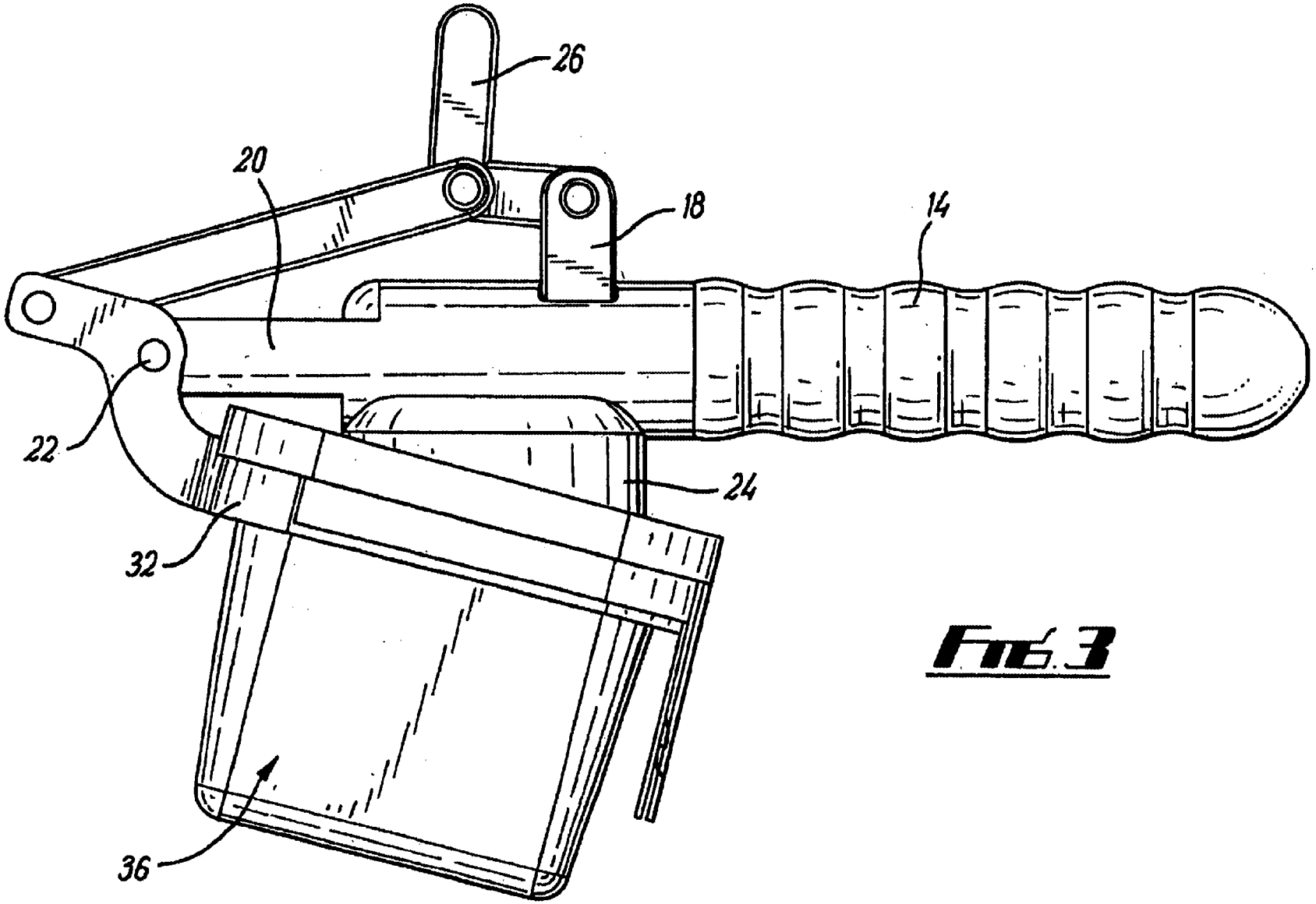
FIG. 3 is a similar view to FIG. 1 but with the apparatus also incorporating a container according to the invention.
Figure 4:
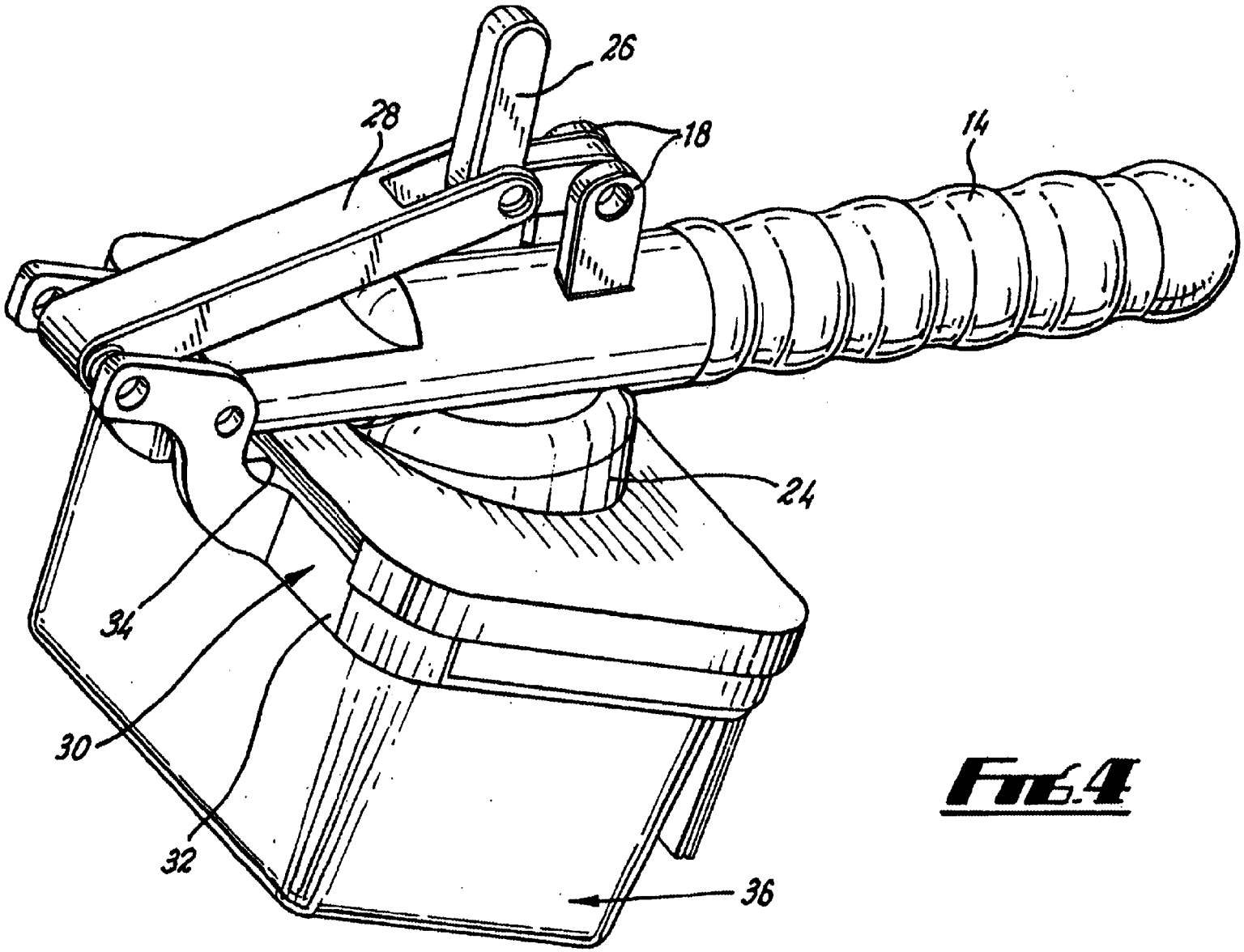
FIG. 4 is a diagrammatic perspective view of the apparatus of FIG. 3.

FIGS. 1 to 7 of the drawings show a first collection apparatus 10 suitable for collecting dog excreta and the like. The apparatus 10 comprises an elongate main member 12. Substantially the right hand half of the member 12 as shown in the drawings is in the form of a gripping handle 14 with ridges and troughs to assist gripping. Extending from the handle 14 is a first part of slightly smaller diameter which has a spaced pair of mounting posts 18 extending upwardly therefrom as shown in the drawings. A second part 20 of the member 12 extends from the first part 16 and has had an upper and lower section cut from the circular section of the first part 16. A transverse mounting hole 22 is provided adjacent the free end of the second part 20. An abutment member 24 in the form of a hollow circular section member which increases in thickness towards the handle 14, is provided on the underside of the first part 16 opposite the mounting posts 18.

An L-shaped handle 26 is pivotally mounted at the end of one limb thereof between the posts 18. An elongate link member 28 is pivotally mounted to the apex of the handle 26. The other end of the link member 28 is pivotally mounted to a frame member 30 which itself is pivotally mounted to the hole 22. The frame member 30 comprises an open square frame 32. The side of the frame 32 nearest the mounting hole 22 is formed with an opening 34. L-shaped arms 35 extend from either side of the opening 34 and are mounted to the hole 22 at their apex and to the link member 28 at the end of the far limb from the opening 34.

Figure 5:
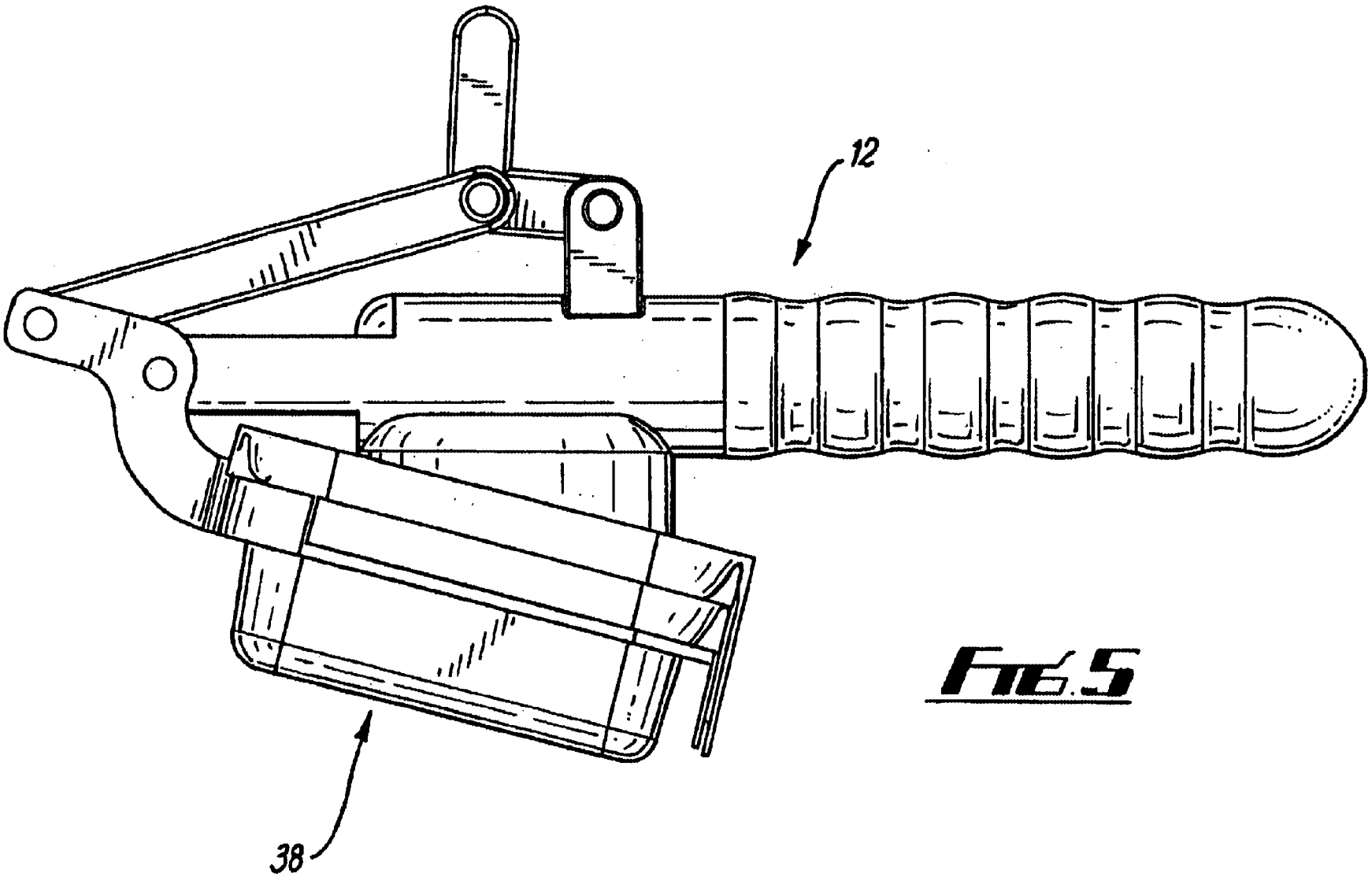
FIG. 5 is a similar view to FIG. 3 but with a smaller container.
Figure 6:
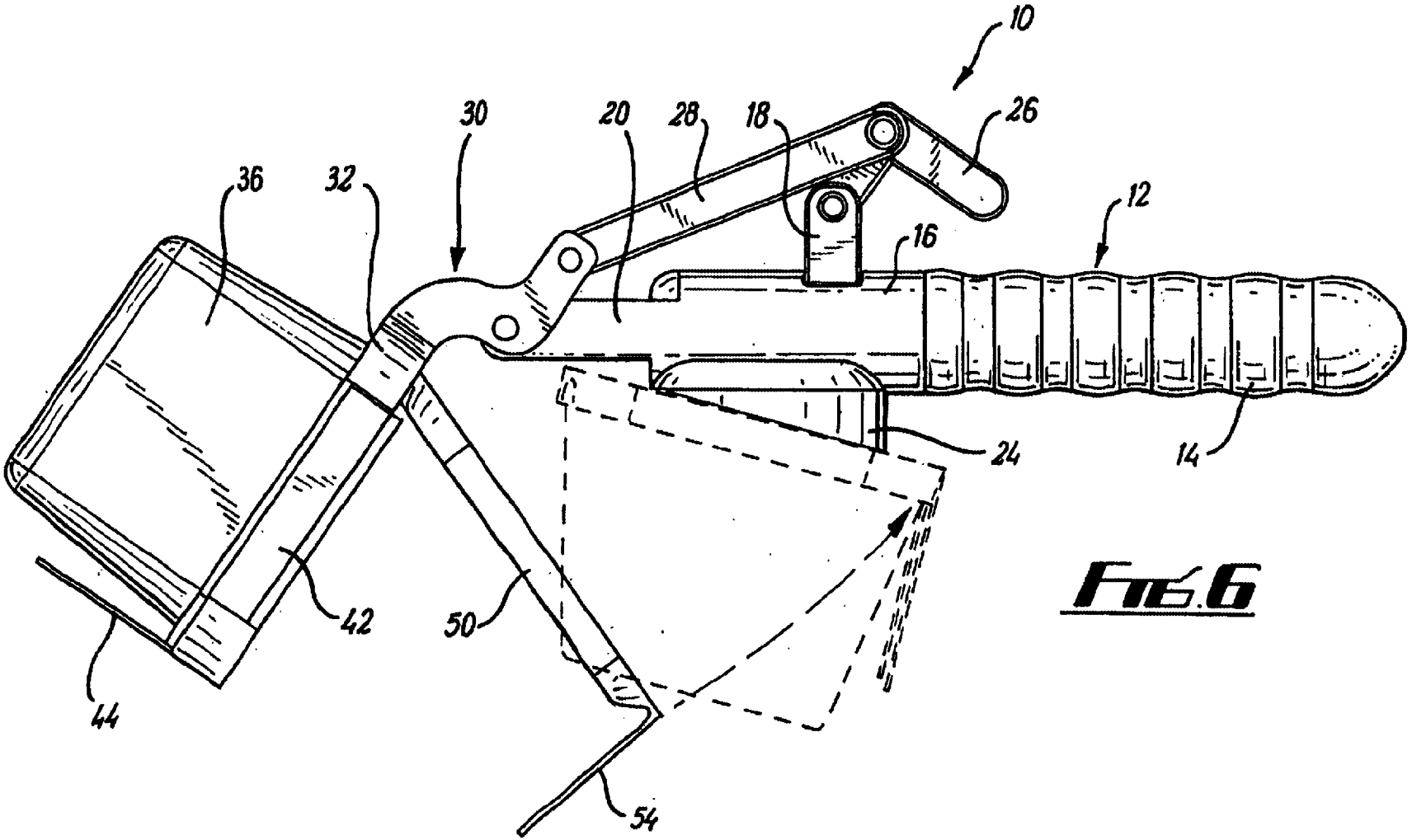
FIG. 6 is a diagrammatic side view of the apparatus of FIG. 3 showing open and closed positions.
Figure 7:
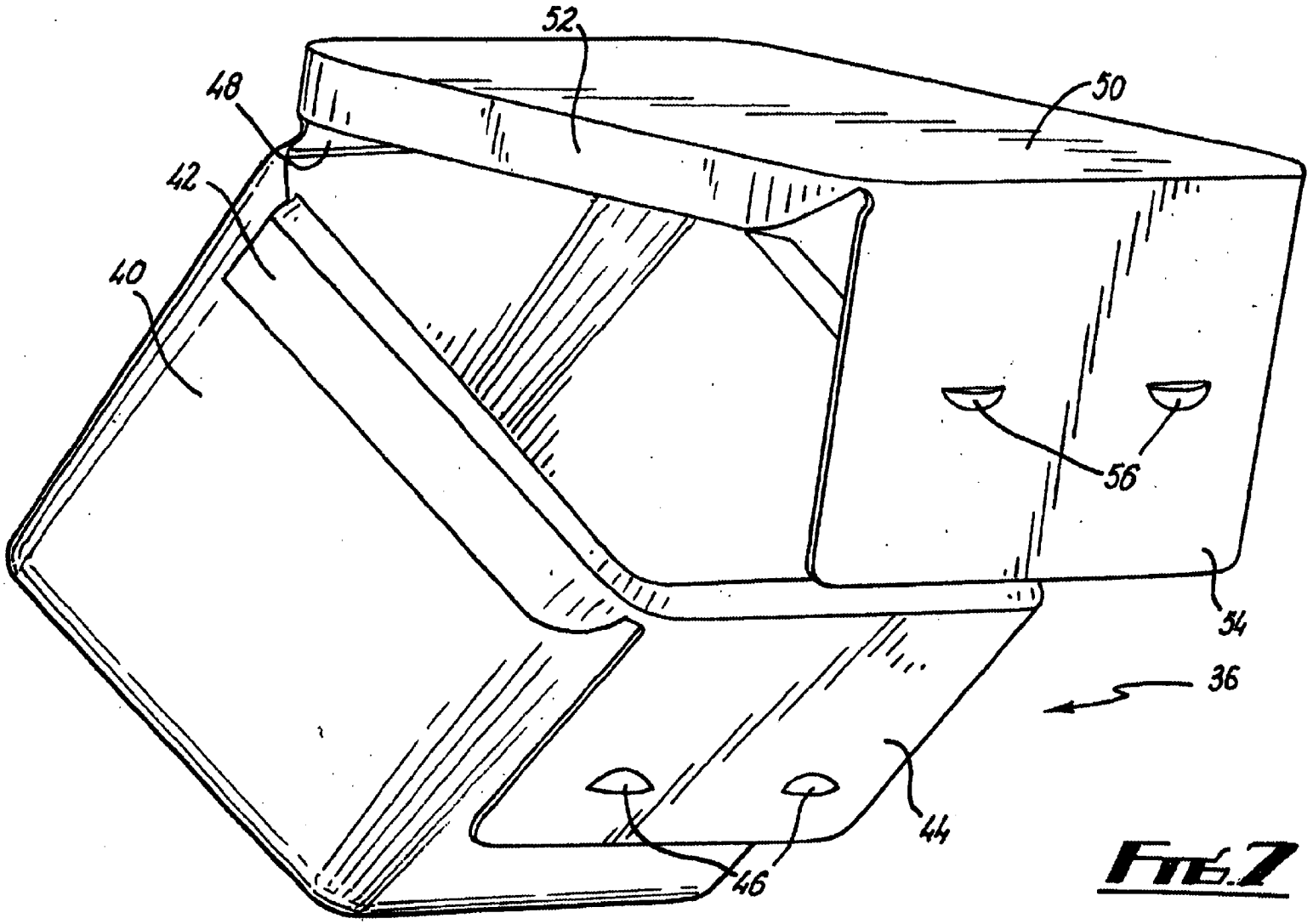
FIG. 7 is a container according to the invention.
Figure 8:
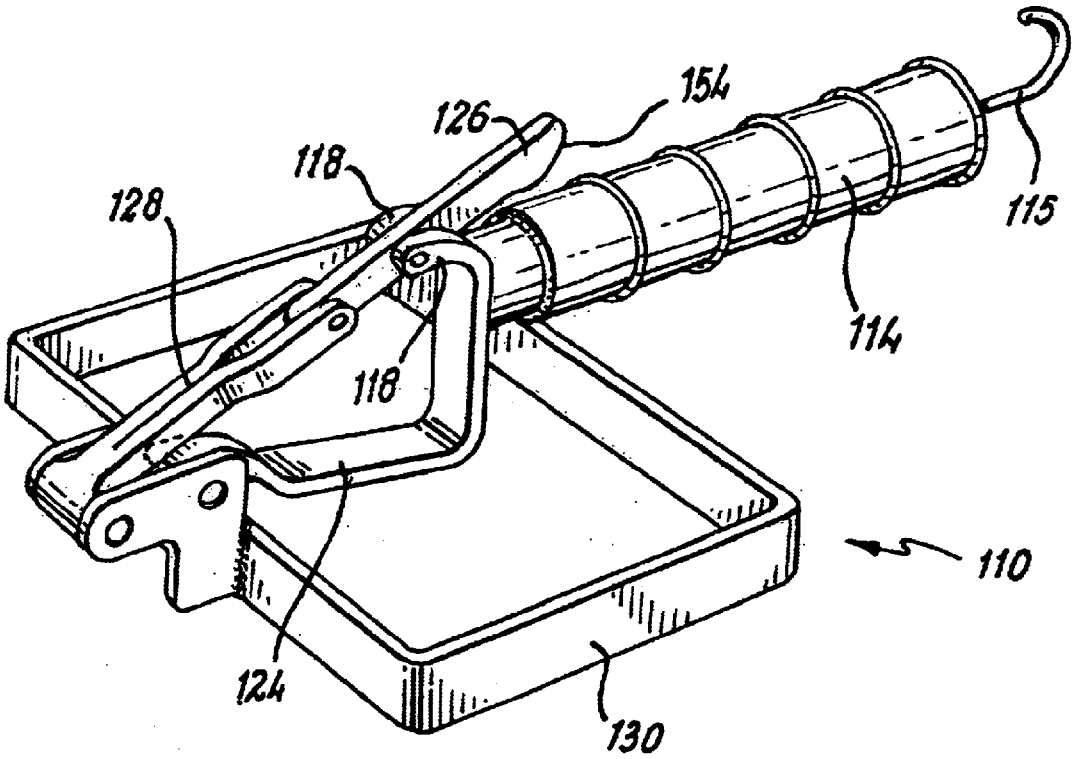
FIG. 8 is a diagrammatic perspective view of a second apparatus according to the invention in a closed position.
Figure 9:
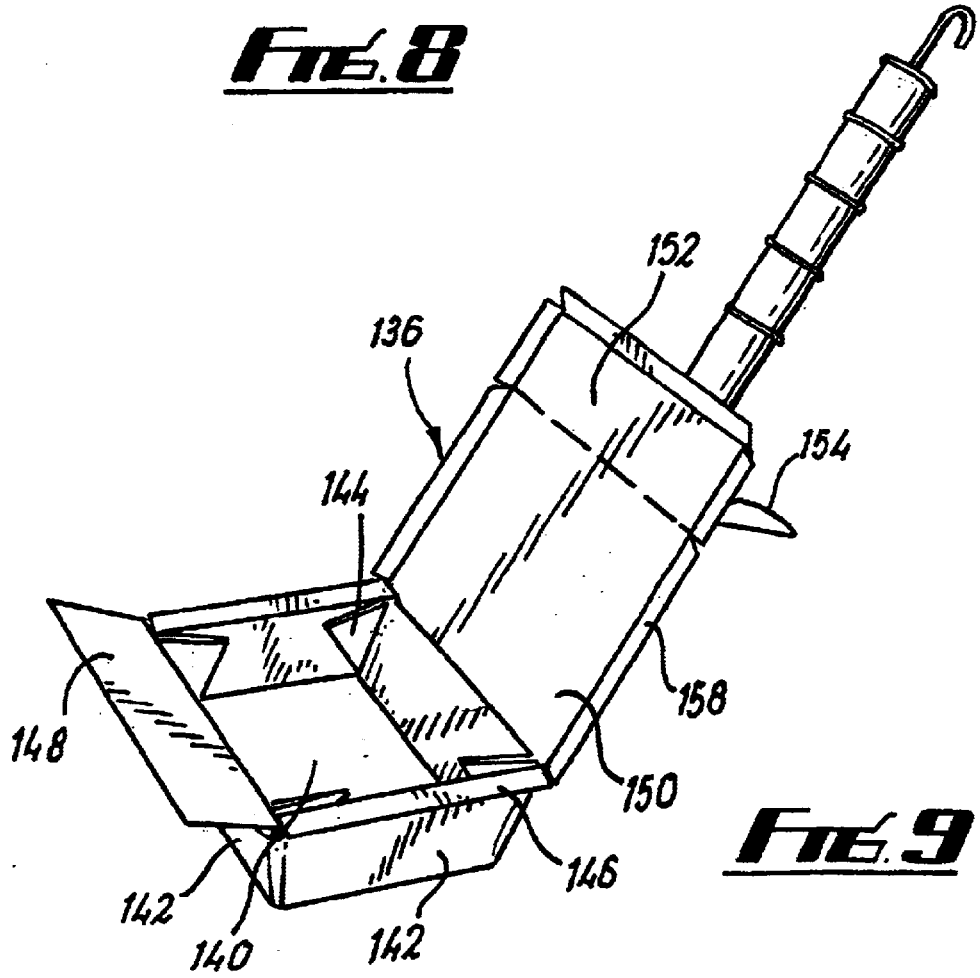
FIG. 9 is a view of the apparatus of FIG. 8 containing a container and in an open condition.

The apparatus 10 also comprises a container 36, a shallower but otherwise similar version 38 of which is shown in FIG. 5. The containers 36,38 comprise a main body 40 of generally square shaped cross-section with rounded corners and which tapers gently outwards in an upward direction. Downwardly extending lips 42 are provided on opposite sides of the body 40, and a larger downwardly turned lip 44 is provided on a further side. Two spaced outwardly extending hemispherical projections 46 are provided on the lip 44 towards the free end thereof.

A hinge 48 is provided on the other side of the body 40 and mounts a lid 50. The lid 50 has side lips 52 which fit over the lips 42 when the lid 50 is closed, and a larger lip 54 which fits over the lip 44. Two inwardly facing projections 56 are provided on the lip 54 to be engageable respectively with the projections 46 to lock the lid 50 in a closed position.

In use, the container 36 or 38 is fitted into the frame 32 with the lips 42,44 engaging therewith. When it is required to clear up dog excreta or anything else, the lid 50 is opened if not already so. The handle 26 is pivoted to the right to the position shown in solid lines in FIG. 6, if this position is not already adopted,.and the excreta or otherwise can readily be scooped up. The lips 42,44 protect the frame 32 from being soiled by the excreta or other. The scooping action can be provided by movement of the apparatus 10 and/or by movement of the handle 26 to the left as shown in the drawings to move the frame member 30 and hence container 36 towards the position shown in dotted lines in FIG. 6.

Once the excreta or other material has been fully scooped up the container 36 can be closed by further movement of the handle 26 to the left causing the lid 50 and subsequently the main body 44 to engage against the abutment 24 to cause the projections 46 and 56 to interengage to lock the lid closed. The container 36 can be discarded by moving the handle 26 back towards the right and the container 36 allowed to simply slide out of the frame 32 into a bin or otherwise. A fresh container 36 can subsequently be used in the apparatus 10.

FIGS. 8 to 14 show a second collection apparatus 110 in use with a container 136. The apparatus 110 is similar to the apparatus 10 and only the differences therebetween will be highlighted. A hook 115 is provided on the free end of the gripping handle 114 to permit the apparatus 110 to be hung up, or worn on a belt or the like. Extending from the other end of the handle 114 and at a slight upwards inclination, is an L-shaped member 124 which operates as an abutment member for closing a container 136.

Rather than an L-shaped handle, a straight handle 126 is provided. The handle 126 is pivotally mounted about a generally midpoint to a pair of mounting posts 118 extending from the top of the stem of the L- shaped member 124. The frame member 130 and link member 128 are generally similar to the corresponding arrangement in the apparatus 10.

The container 136 is formed from a cardboard blank 138. The blank 138 comprises a base part 140 from which extend four side parts 142. All the parts of the blank 138 are interconnected by creased lines or other formations which permit folding. Each pair of adjacent side parts 142 is interconnected by a folding arrangement comprising two identical triangular parts 144. Side lips 146 are provided on the tops of one opposite pair of the side parts 142 to extend over the sides of the frame member 130. The other pair of opposite side parts 142 mount respectively a main lip 148 or a lid 150 from which a further lip 152 extends. Side flanges 158 are provided on the lid 150 and lip 152 which can be folded to upstand therefrom.

Figure 14:
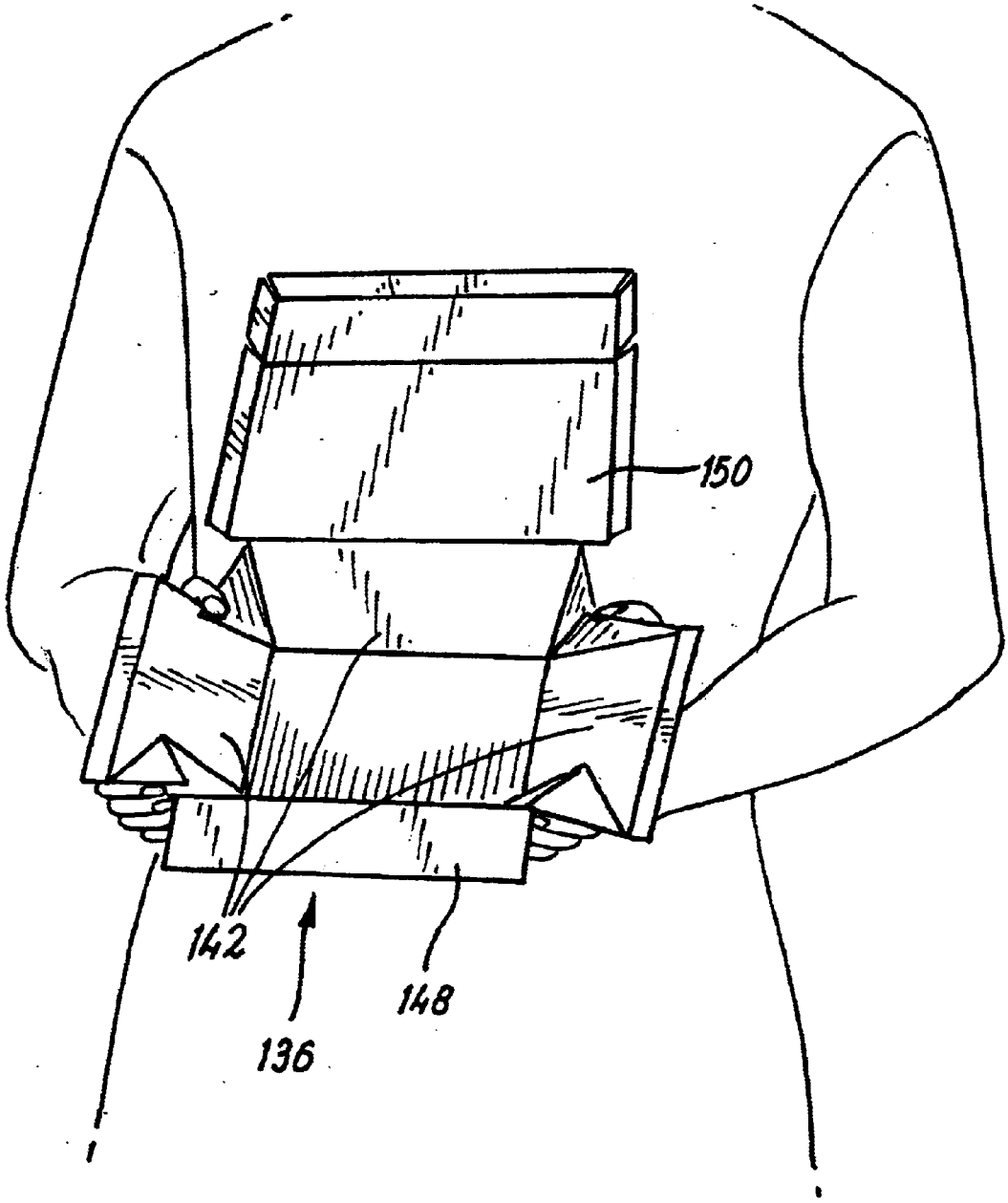
FIG. 14 is a diagrammatic perspective view showing the container of FIG. 13 being assembled.

The blank 138 can be moved to an erect condition by pushing one pair of opposite side parts 142 together as shown in FIG. 14. This causes the other opposite side parts 142 to move together. The blank 138 may be arranged to automatically stay in that position perhaps by providing areas of adhesive for instance on some of the triangular parts 144. Such adhesive areas may be provided with a removable backing paper. Alternatively, the blank may be held in position by stapling means or could be held in position by location in the frame member 130.

In use, the container 136 is located in the frame member 130 with the lid 150 open. If not already so, the apparatus 1

Figure 10:
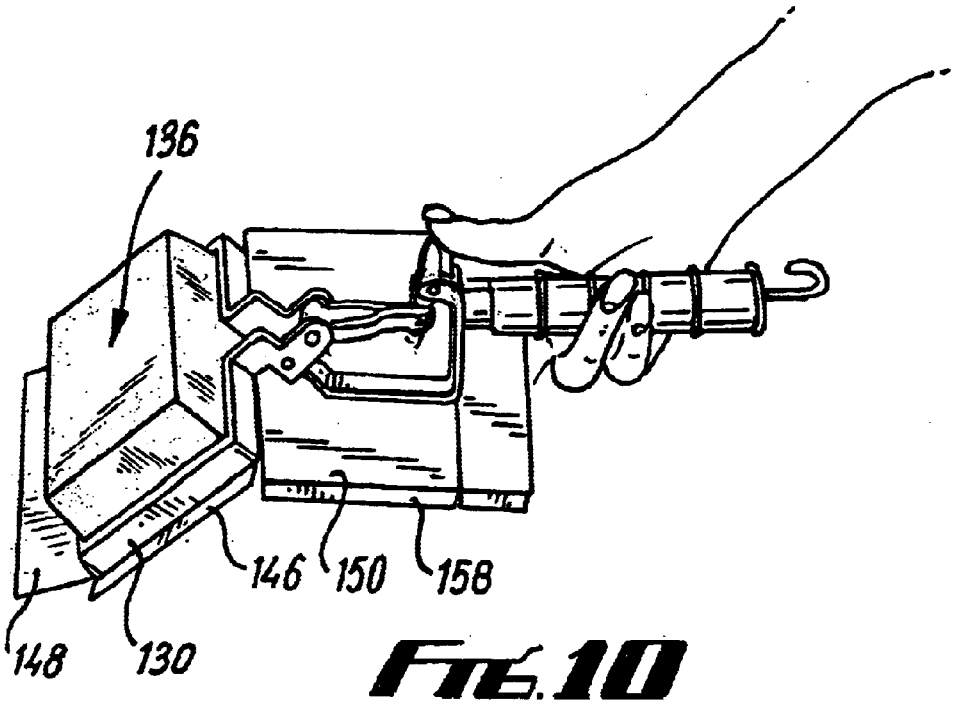
FIG. 10 is a diagrammatic view of the arrangement shown in FIG. 9 in use.
Figure 11:
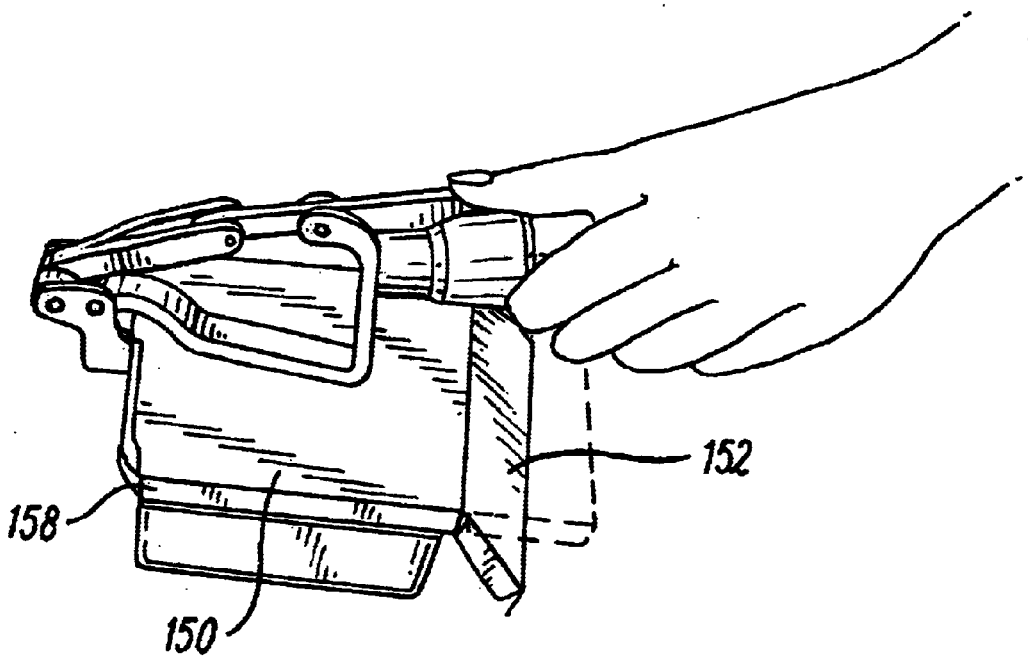
FIG. 11 is a diagrammatic perspective view of the arrangement of FIG. 9 in a closed position.

10 can be fully opened by pushing the free end of the handle 126 away from the gripping handle 114. The apparatus 110 can then be moved over the ground as shown in FIG. 10 to urge dog faeces or other material into the container 136. The main lip 148 protects the frame member 130 from being soiled. Once material is collected the container 136 is closed by pulling the free end 154 down towards the gripping handle 114, such that the lid 150 is urged by the L-shaped member 124 against the top of the container 136.

The handle 126 and link member 128 are arranged such that when the apparatus 110 is fully closed there is an overcentre lock to retain the closed position. Adhesive may be provided for instance on the side lips 146 to retain the lid 150 in a closed condition. The flanges 158 enclose the side lips 146 and the main lip 148, thereby preventing any material thereon coming into contact with the user.

Figure 12:
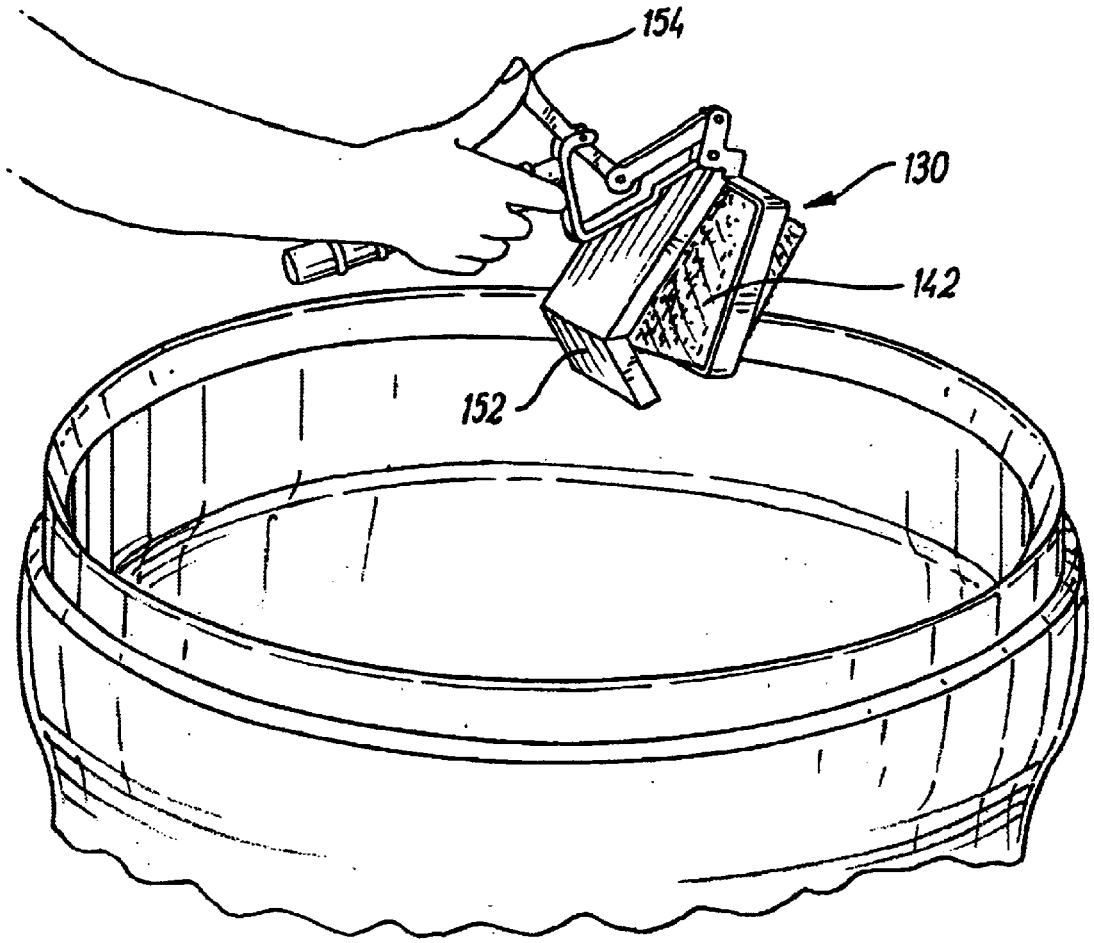
FIG. 12 is a further diagrammatic view of the arrangement of FIG. 9 in use in a closed position.
Figure 13:
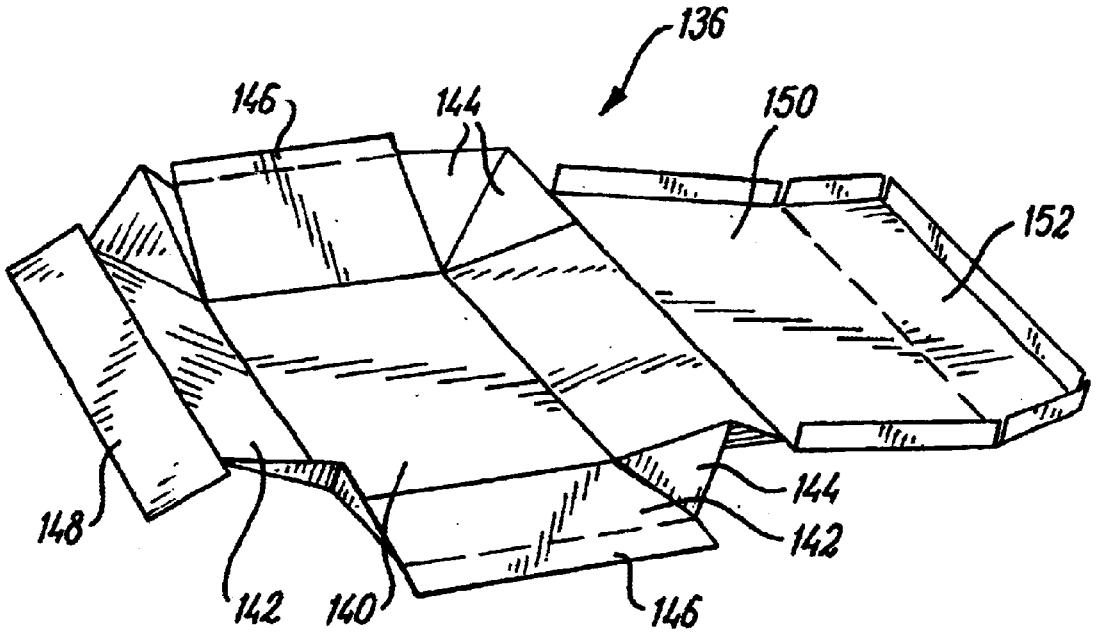
FIG. 13 is a diagrammatic perspective view of the container of FIG. 9 in a partially assembled condition.

When it is required to discard the container 136, the handle 126 is again moved away from the gripping handle 114 and the container 136 can slide out of the frame member 130 into a bin for instance, as shown in FIG. 12.

Figure 15:
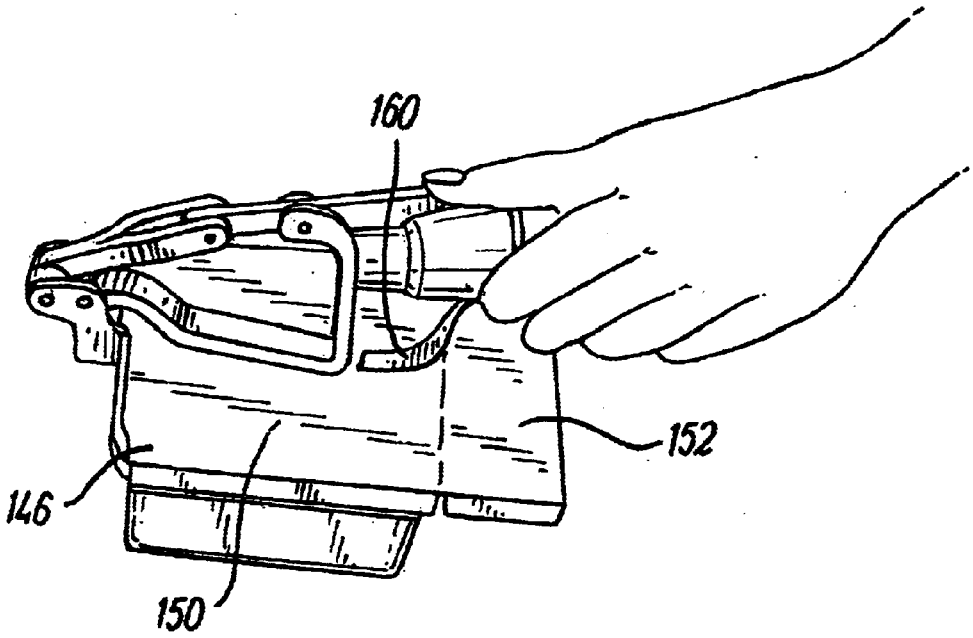
FIG. 15 is a similar view to FIG. 11 but with a modified container.

FIG. 10 shows the lid 150 being held fully open by hand. Means may be provided on the apparatus 110 for providing full opening of the lid 150 without soiling of the hands. FIG. 15 shows a strip 160 of flexible material which extends from the top of the lid. 150 and can be held by gripping the handle 114 as shown. Other such means for providing full opening of the lid 150 may comprise adhesive, an element which pierces the lid 150, or a clip arrangement. Whilst the blank is shown made of card, other materials could be used in the blank.

There are thus described apparatus which readily permit dog excreta and other materials to be picked up without contact by a user until the material is safely located in a closed container. The apparatus are of relatively simple construction and can thus be inexpensively and robustly manufactured. The apparatus can readily be carried with a supply of containers, which containers can be stacked into or onto each other.

Various other modifications may be made without departing from the scope of the invention. For example, different containers may be used. A different arrangement for moving the frame member may be provided. Different means could be provided for locking the container in a closed condition.

Whilst endeavouring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

What is claimed is:

1. A collection apparatus comprising a) a main member including a body which can be held by a user and a frame;

b) the frame being adapted to removably mount an open top container with a lid;

c) the frame being movably mounted on the body;

d) an abutment carried by the body;

e) the frame being movable between a first position wherein material can be scooped up into such container, and a second position for urging such lid into engagement with the abutment to substantially close such container; and, f) a linkage connected to the body and the frame for moving the frame between the first and the second position and having an over center position for retaining the frame in the second position.

2. Apparatus according to claim 1 characterized in that the linkage includes an operating handle connected the frame to facilitate movement of the frame relative to the body.

3. Apparatus according to claim 2 characterized in that the operating handle is pivotally mounted on the body and pivotally connected to the frame.

4. Apparatus according to claim 1 characterized in that the frame member comprises an open frame through which a part of a container can extend, while a wider part of the container engages the frame.

5. Apparatus according to claim 1 characterized in that the apparatus further comprises a container removably mountable thereon to receive material.

6. Apparatus according to claim 5 characterized in that the container includes an upper part which engages the frame and a pivotally mounted lid which is closable against said abutment and said upper part.

7. A collection apparatus comprising:

a) a handle having a grip portion near one end;

b) a container supporting member pivotally connected to the handle at a location near an end opposite said one end;

c) the member including a container supporting frame to one side of the pivotal connection and an arm extending from the connection oppositely from the frame;

d) a manually actuable linkage interposed between the arm and the handle for shifting the frame between a storage position and a scooping position; and, e) an abutment carried by the handle, the abutment being positioned in alignment with a container receiving opening deliniated by the frame when the frame is in the storage position whereby to close and maintain closed a lid of a disposable container carried by the frame.

8. In combination with the apparatus of claim 7, a disposable collection container comprising a unitary sheet including:

a) a rectangular base wall having a pair of ends and a pair of sides;

b) pair of side and end walls foldably connected to a different one of the base wall sides and ends;

c) four gussets each connected to a different pair of adjacent side and end walls whereby to permit the side and end walls to be folded up relative to the base wall to form the sides of a rectangular solid box defining a fillable space the box being disposed in the frame opening;

d) a lid foldably connected to one side of the walls by a hinge, the lid being in container closing engagement with the abutment when the frame is in the storage position;

e) three support lips respectively to connected to the end walls and the other side walls for folding over a collection apparatus frame;

f) the support lips being foldable outwardly and downwardly relative to the space whereby to supportively overlie two ends and a side of such frame;

g) the lid including a closure lip for juxtaposition with the other of said side walls such that when the sheet is folded to form a container and the lid is in a closed position the lid, the base wall, the end walls and the side walls collectively surround and delineate the space; and, h) the lid including foldable end lips each for juxtaposition with selected and associated ones of the end walls and the end wall lips.

9. The combination of claim 8, wherein the closure lip includes foldable side and end parts for coacting with the remainder of the closure lip in maintaining the lid in a closed position.

10. The combination of claim 8 further including pressure sensitive adhesive adhered to the sheet for maintaining the sheet in its folded condition.

11. The container of claim 10 wherein the adhesive is secured to at least certain of the gussets.

12. The apparatus of claim 7 wherein the linkage includes a manually actuated lever positioned near the grip portion for thumb activation to move the frame between the storage and scooping positions.

* * * * *